US005143024A

United States Patent [19]

Yokoyama et al.

[11] Patent Number: 5,143,024

[45] Date of Patent: Sep. 1, 1992

[54] PRESSURE FLUIDIZED BED FIRING BOILER

[75] Inventors: Tomomitsu Yokoyama; Katsuji Hamasaki, both of Tokyo; Koichiro Otsubo, Nagasaki, all of Japan

[73] Assignee: Mitsubishi Jukogyo Kabushiki Kaisha, Tokyo, Japan

[21] Appl. No.: 612,143

[22] Filed: Nov. 13, 1990

[30] Foreign Application Priority Data

Nov. 13, 1989 [JP] Japan ..... 1-131813[U]
Nov. 13, 1989 [JP] Japan ..... 1-131814[U]
Nov. 13, 1989 [JP] Japan ..... 1-294296

[51] Int. Cl.[5] ..... F22B 37/24

[52] U.S. Cl. ..... 122/510; 122/4 D; 122/24

[58] Field of Search ..... 122/4 D, 510, 240 R

[56] References Cited

U.S. PATENT DOCUMENTS

| | | | |
|---|---|---|---|
| 2,641,233 | 6/1953 | Hemenway et al. | 122/240 |
| 2,920,609 | 1/1960 | Iager et al. | 122/240 |
| 3,863,606 | 2/1975 | Bryers et al. | 122/4 D |
| 4,263,964 | 4/1981 | Masai et al. | 122/510 |
| 4,290,388 | 9/1981 | Ruhe et al. | 122/510 |
| 4,510,892 | 4/1985 | Wincze | 122/510 |
| 4,604,972 | 8/1986 | Difonzo et al. | 122/510 |
| 4,641,608 | 2/1987 | Waryasz | 122/8 D |
| 4,665,864 | 5/1987 | Seshamani et al. | 122/4 D |

FOREIGN PATENT DOCUMENTS

| | | |
|---|---|---|
| 0266637 | 5/1988 | European Pat. Off. . |
| 0270086 | 6/1988 | European Pat. Off. . |
| 1248060 | 3/1968 | Fed. Rep. of Germany . |
| 0129486 | 12/1984 | France . |
| 1541353 | 2/1979 | United Kingdom . |
| 2068094 | 8/1981 | United Kingdom . |

OTHER PUBLICATIONS

*Heat Engineering,* vol. LII, No. 6, Sep.-Dec. 1986, pp. 100-107, "Developing the Turbocharged Pressurized Fluidized Bed Combustion Boiler", S. J. Goidich.

*Primary Examiner*—Henry C. Yuen
*Attorney, Agent, or Firm*—Wenderoth, Lind & Ponack

[57] ABSTRACT

A support structure supports a fluidized bed firing boiler disposed within a cylindrical pressure vessel and operated while the inside of a fluidized bed furnace is kept pressurized. A main body of the pressure fluidized bed firing boiler disposed within the pressure vessel is divided into a suspended section suspended from a support beam disposed at an upper interior portion within the pressure vessel, and a bottom-supported section supported by a support beam disposed at a lower interior portion of the pressure vessel. Also, a metallic expansion joint in the form of an undulated plate is provided at a point of engagement between the suspended section and the bottom-supported section.

3 Claims, 6 Drawing Sheets

PRESSURE FLUIDIZED BED FIRING BOILER

BACKGROUND OF THE INVENTION

1. Field of the Invention

The present invention relates to the structure of a pressure fluidized bed firing boiler disposed within a pressure vessel, for example, a support structure of a pressure fluidized bed firing boiler or a reinforcement structure of the pressure vessel, and more particularly to an improved structure of a pressure fluidized bed firing boiler which contributes to a down-sizing and reduction in weight thereof.

2. Description of the Prior Art

In a heretofore known structure for supporting a pressure fluidized bed firing boiler disposed within a pressure vessel, a system for suspending the entire load of a supporting object of the boiler main body from a support beam provided at within the pressure vessel has been employed.

However, in the case where such a system for suspending an entire load of a supporting object of the boiler main body from a support beam is employed, if the fluidized bed firing boiler is to have a large capacity, the support beam structure must be large and a load acting upon a shell of the pressure vessel is correspondingly large. Hence, there exists a problem in that a strong reinforcement structure for the shell is necessitated.

Also, in order to resolve such a problem, one can conceive of a system in which the entire load of the supporting object of a boiler main body is supported by a support beam provided under the pressure vessel. However, if such a system were employed in a large-capacity fluidized bed firing boiler, the compression load acting upon peripheral wall pipes of the boiler would become maximum, and hence the load could exceed the buckling strength of the vessel.

Further, in a heretofore known pressure fluidized bed firing boiler disposed within a vertical type pressure vessel, the fluidized bed main body accommodates an evaporator, a superheater and a reheater in the same furnace.

However, in such a fluidized bed main body, there exists a problem in that the combustion control means, provided as a countermeasure against the reheating of the tubes upon the starting of the pressure fluidized bed firing boiler, is complicated.

Furthermore, in the prior art, as a pressure vessel for containing a pressure fluidized bed firing boiler, though a cylindrical pressure vessel of a vertical type is known, a cylindrical pressure vessel of a horizontal type does not exist.

Now, in the case where a cylindrical pressure vessel of a horizontal type contains a pressure fluidized bed firing boiler, although a cylindrical cross section of the vessel can be maintained merely by the mechanical strength of a shell of the vessel when the vessel has a relatively small diameter, when the vessel has a large diameter and is extremely thin, a large flexure is generated in the circumferential direction of the cylindrical shell. Hence, the shell will deform into an elliptical shape, and there is a risk that the fluidized bed main body within the pressure vessel may be damaged.

In addition, a support system for supporting the fluidized bed main body and a frame structure serving as an operating scaffold must be provided within the vessel. Because many members are accordingly disposed in a narrow space, there are many restrictions in design, sometimes resulting in an uneconomical design. Such problems also must be resolved.

SUMMARY OF THE INVENTION

Therefore, a first object of the present invention is to eliminate the shortcoming of the above-described supporting system for a boiler main body in the prior art so that the support structure can be small, and to achieve a reduction in the compression load exerted by the boiler main body.

A second object of the present invention is to simplify the combustion control means provided as a countermeasure against the reheating of the tubes upon the starting of the pressure fluidized bed firing boiler.

Furthermore, a third object of the present invention is to obviate flexure of a cylindrical pressure vessel of a horizontal type containing a pressure fluidized bed firing boiler therein, by providing a relatively simple reinforcement structure within the pressure vessel.

One feature of the present invention resides in that the fluidized bed firing boiler disposed within a pressure vessel is divided into a suspended section supported from a support beam disposed at an upper interior portion of pressure vessel and a bottom-supported section supported by a support beam disposed at a lower interior portion of the pressure vessel, and in that a metallic expansion joint is provided at an engaging portion between the suspended section and the bottom-supported section.

Accordingly, even a large-capacity fluidized bed firing boiler can be supported without greatly increasing the structural strength of a support beam and the like.

In addition, a difference in thermal expansion between the suspended section and bottom-supported section can be easily absorbed by the metallic expansion joint.

Another aspect of the present invention resides in that a fluidized bed portion in a pressure fluidized bed firing boiler of a vertical type is perfectly divided into two so as to have respective fluidized beds disposed at upper and lower levels, these levels are defined one above the other within the pressure vessel, and combustion controls for the respective fluidized beds are provided independently of each other.

Since combustion control can be carried out individually in the respective fluidized beds, each combustion control means can be relatively simple. In addition, as a result of the fact that the fluidized beds are disposed at two levels one above the other within the pressure vessel of a vertical type, the diameter of a shell of the pressure vessel can be made small.

Still another feature of the present invention resides in annular reinforcement beams mounted to an inner circumference of a cylindrical pressure vessel of a horizontal type which contains a pressure fluidized bed firing boiler therein, and in support beams for supporting a fluidized bed main body which are constructed as a truss-like structure.

In the above-mentioned structure, the annular reinforcement beams serve to maintain the cylindrical cross section of the pressure vessel. And, since the annular reinforcement beams are mounted to the inside of the pressure vessel, a thermal stress generated at the engaging portion between the annular reinforcement beams and the pressure vessel can be made small as compared to the case where the beams are mounted to the outside of the pressure vessel.

Also, owing to the fact that the reinforcement is constructed of the annular reinforcement beams (rings) and a truss of support members, the support members of the truss can be used both as a frame for supporting the fluidized bed main body and as an operating scaffold within the pressure vessel. Accordingly, only a simple frame structure within the pressure vessel need be provided.

The above-mentioned and other objects, features and advantages of the present invention will become more apparent by referring to the following description of preferred embodiments of the invention taken in conjunction with the accompanying drawings.

DESCRIPTION OF THE PREFERRED EMBODIMENTS

Figure 1:
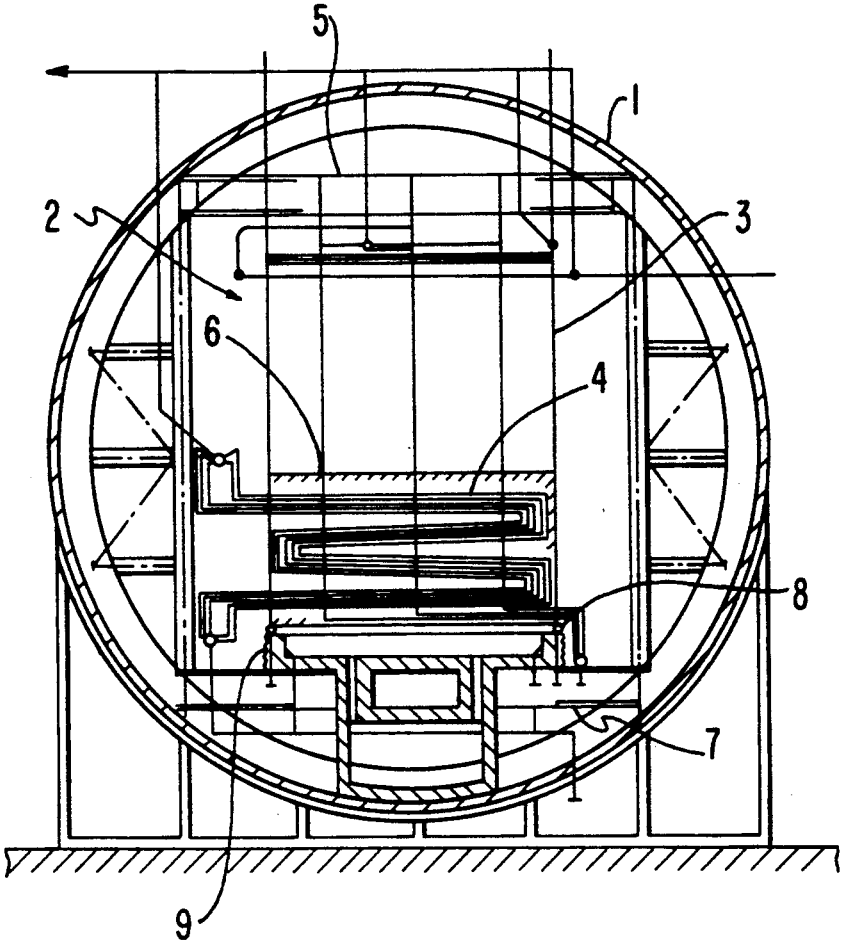
FIG. 1 is a cross-sectional view of one embodiment of a structure for supporting a horizontal type of pressure fluidized bed firing boiler according to the present invention.
Figure 2:
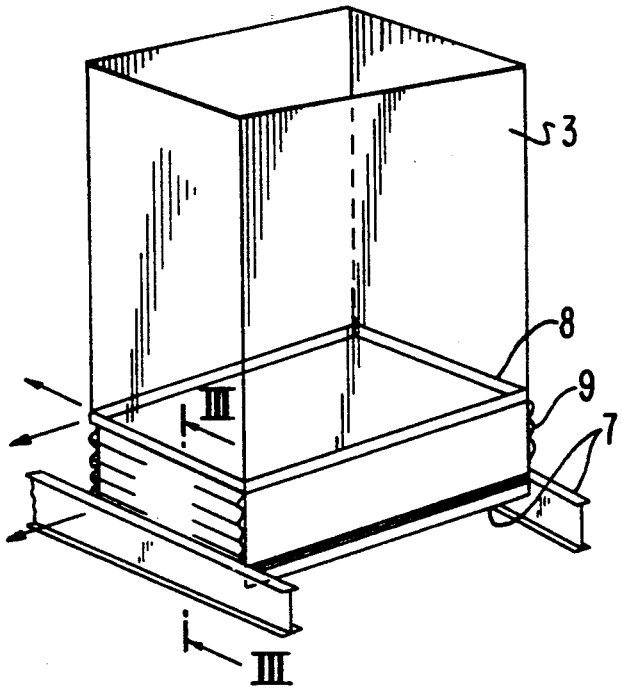
FIG. 2 is a schematic perspective view of the structure shown in FIG. 1.

Now one preferred embodiment of the present invention will be described in greater detail with reference to the accompanying drawings.

In FIGS. 1–4, a fluidized bed peripheral wall 3 and intralayer tubes 4 forming constituent members of a fluidized bed firing boiler 2 disposed within a pressure vessel 1, are suspended from a support beam 5 provided at an upper interior portion of the pressure vessel 1. When the operation of the fluidized bed firing boiler is stopped, a load of fluidized material (solid) 6 within the fluidized bed furnace is supported from below by a support beam 7 provided at a lower interior portion of the pressure vessel 1. Accordingly, two loads in the fluidized bed firing boiler 2 are supported, namely the suspended fluidized bed peripheral wall 3 and the intralayer tubes 4 (suspended section) and the fluidized material 6 supported from below (bottom-supported section).

Furthermore, differences in the thermal expansion of the suspended section (4 and 5) and the bottom-supported section (6) are accommodated for during operation by an expansion joint 9 provided between a fluidized bed peripheral wall inlet tube header 8 and the lower support beam 7. This expansion joint 9 is made of metal because it is subjected to a surface load caused by a pressure difference between the inside of the fluidized bed and the inside of the pressure vessel.

Figure 3:
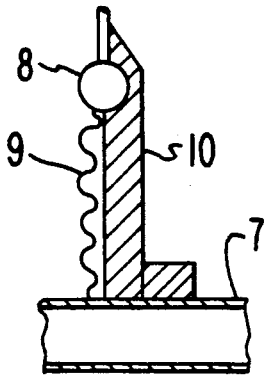
FIG. 3 is a cross-sectional view taken along line III—III in FIG. 2.
Figure 4:
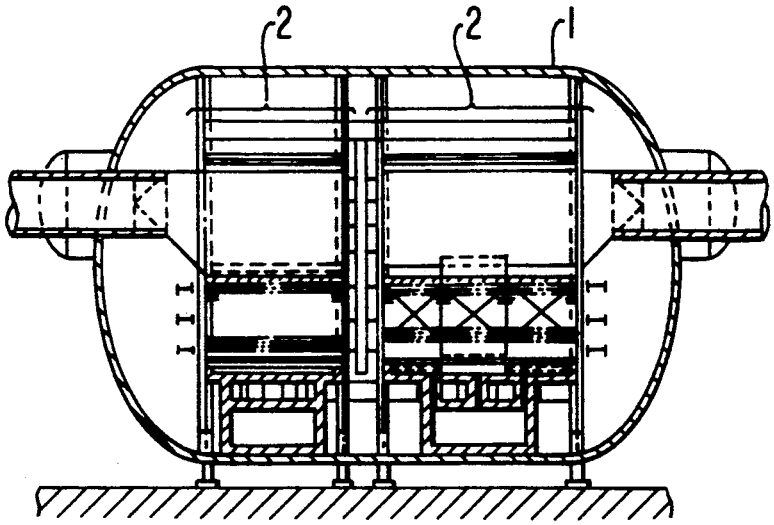
FIG. 4 is a schematic longitudinal cross-sectional view of a horizontal type of pressure fluidized bed firing boiler.

It is to be noted that in the embodiment of FIG. 3, refractory heat-insulating material 10 is provided within the fluidized bed on a side of the expansion joint 9 in order to prevent the deterioration and damage of the expansion joint 9 caused by the fluidized material (solid) 6 having a high temperature.

As described above, according to the illustrated embodiment, a fluidized bed firing boiler disposed within a pressure vessel, in which the suspended section and the bottom-supported section are separately supported, can have a large-capacity without the need to greatly improve support structure such as support beams.

In addition, because only a tensile load is applied to the fluidized bed peripheral wall tubes, it is unnecessary to take any counter-measure against a compression load on the peripheral wall tubes (such as enhancing the rigidity of the tubes or increasing a number of stages of peripheral wall back stays to prevent buckling of the peripheral wall tubes which would tend to occur if the tubes were supported from below).

Furthermore, a difference in thermal expansion, upon operation of the fluidized bed firing boiler, at the point of engagement between the suspended section and the bottom-supported section can be easily absorbed by the metallic expansion joint.

Now another preferred embodiment of the present invention will be described in detail with reference to the accompanying drawings.

Figure 5:
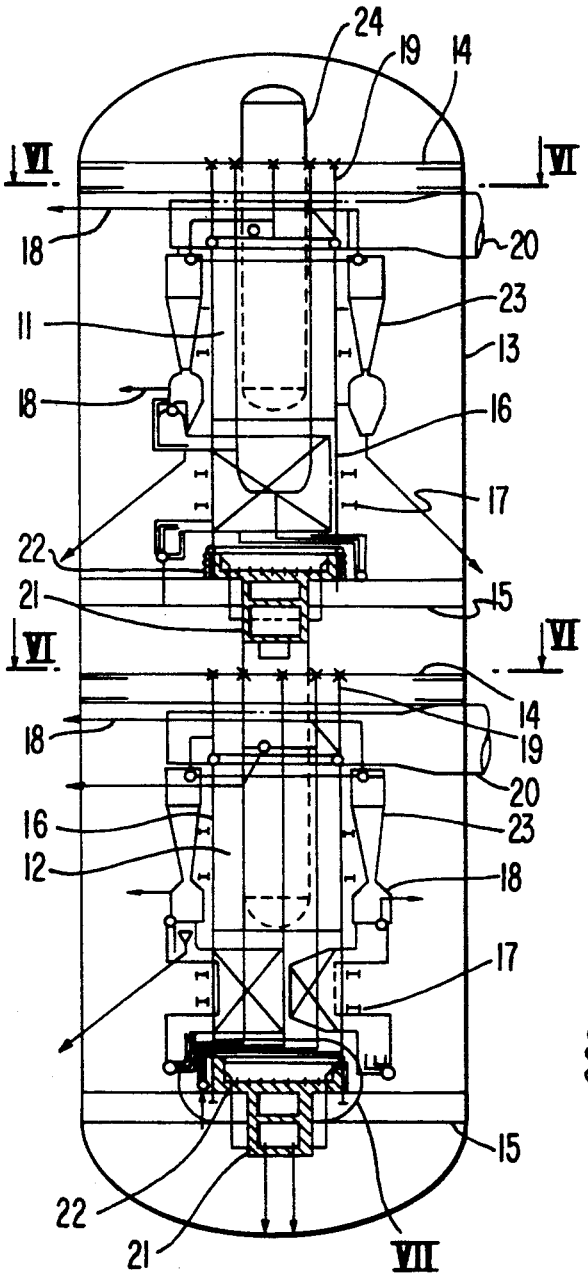
FIG. 5 is a schematic vertical cross-sectional view of another preferred embodiment of a pressure fluidized bed firing boiler according to the present invention.
Figure 6:
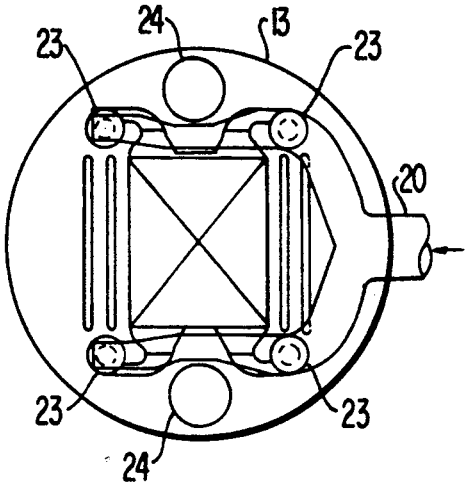
FIG. 6 is a cross-sectional view taken along either of the lines VI—VI in FIG. 5.
Figure 7:
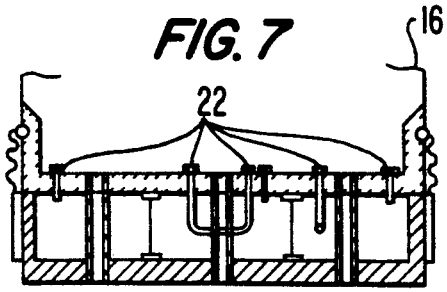
FIG. 7 is an enlarged longitudinal cross-sectional view of the portion of the boiler encircled by line VII in FIG. 5.

In FIGS. 5 to 7, an upper side fluidized bed firing furnace (evaporator furnace) 11 and a lower side fluidized bed firing furnace (superheater/reheater furnace) 12, which form two perfect halves of the boiler according to the present invention, are disposed in a two-level overlapped system of structures respectively supported by support beams 14 and frame tables 15 provided within a vertical type pressure vessel 13.

And both fluidized bed main bodies respectively comprise furnace wall tubes 16, furnace wall back stays 17, communication pipes 18, fluidized bed support systems 19, outlet gas ducts 20, bottom wind chambers 21, and feeders 22 of coal, lime and air and the like. In addition, cyclones 23, ash storage bins 24 for controlling a layer height, and the like are also provided within the vertical type pressure vessel 13 as appendant device for use with the respective fluidized bed main bodies. These members are arranged properly and effectively within the vertical type pressure vessel so as to minimize the necessary diameter of the shell of the vessel.

As described above, according to this preferred embodiment, a pressure fluidized bed firing boiler disposed within a vertical type pressure vessel is divided exactly into two constituent parts each including a fluidized bed and respectively disposed at upper and lower levels within the vertical type pressure vessel in an overlapped relation. Each of the fluidized beds is associated with a feeder of coal, lime and air and a layer height control device, whereby combustion control can be carried out individually. Therefore, combustion control means for protecting reheating tubes upon the starting of the boiler can be relatively simple.

In addition, the employment of the two-level overlapped system of a structures of fluidized beds within a vertical type pressure vessel contributes to the downsizing of a shell of the pressure vessel.

Furthermore, the pressure fluidized bed firing boiler of the type according to this preferred embodiment is advantageous when applied to a pressure fluidized bed combined plant having a relatively small capacity, in that a small weight-to-output ratio can suffice.

Moreover, it is advantageously possible to produce a low weight plant by providing a plurality of vertical type pressure fluidized bed firing boilers according to this embodiment to form a large-capacity combined plant.

In other words, if fluidized bed firing boilers provided with horizontally arranged and vertically extending vessels are generally compared to each other, an arrangement of a plurality of small-capacity vertical vessels is most significant with respect to weight savings associated with the vessel(s). Such a comparison in indicated in the following table.

| Type | Name | Number of Vessels | H | D | L | Weight | Significance |
|---|---|---|---|---|---|---|---|
| A | Large-capacity Horizontal Vessel | 1 | 100 | 100 | 100 | 100 | 3 |
| B | Small-capacity Horizontal Vessel | 3 | 100 | 90 | 55 | 95 | 2 |
| C | Small-capacity Vertical Vessel | 3 | 100 | 60 | 85 | 70 | 1 |

Figure 8:
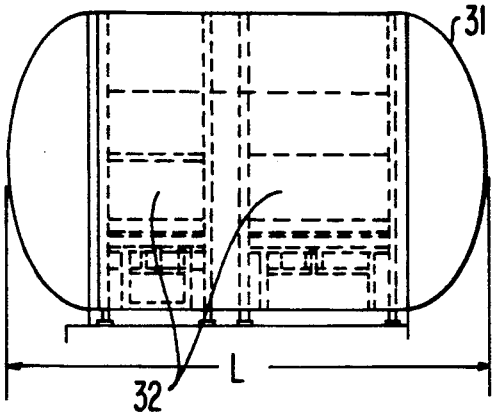
FIGS. 8(*a*) and 8(*b*), FIGS. 9(*a*) and 9(*b*) and FIGS. 10(*a*) and 10(*b*) are schematic views of a large-capacity vessel of a horizontal type, a small-capacity vessel of a horizontal type and a small-capacity vessel of a vertical type, respectively, used in explaining the advantages of the present invention.
Figure 8:
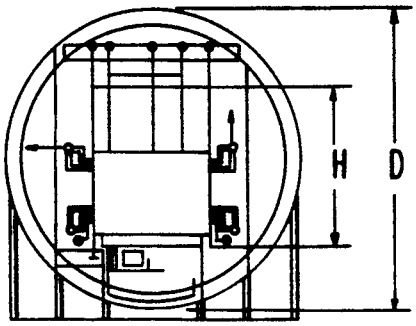
Figure 10:
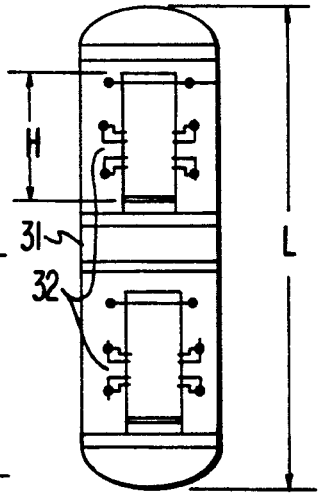
Figure 9:
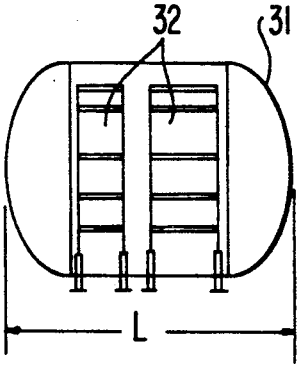
Figure 9:
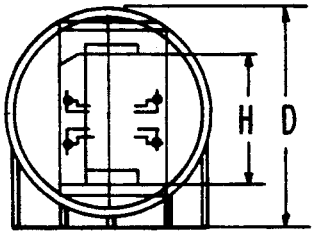
Figure 10:
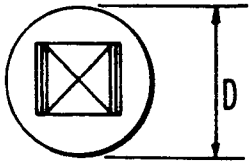

In this table, type A is a large-capacity horizontal vessel shown in FIG. 8, type B is a small-capacity horizontal vessel shown in FIG. 9, and type C is a small-capacity vertical vessel shown in FIG. 10 (the present invention). H (height of a furnace), D (outer diameter: diameter of the shell of the vessel) and L (length of the shell) are the respective dimensions indicated in FIGS. 8 to 10. The weight indicated for types B and C is the total weight of all the vessels (three vessels). And in FIGS. 8 to 10, reference numeral 31 designates a pressure vessel, and numeral 32 designates a fluidized bed firing boiler.

Now, in the case where the pressure vessel is of a horizontal type, it is necessary to insure a furnace height H sufficient for fluidized bed firing of the fluidized bed firing boiler 32. Hence, the shell diameter D must be larger than that of a vertical type of pressure vessel. In the case of a vertical type of pressure vessel, a large shell diameter need not be provided because the dimension of the furnace height H extends vertically along the vessel axis. If the shell diameter of the vessel is made large, the shell thickness and peripheral length would be correspondingly increased, and so would the weight. Because of such reasons, it is very advantageous to construct a fluidized bed firing boiler combined plant having a large-capacity output by arraying and combining a plurality of vertically extending vessels of type C according to the present invention, which have a small weight as compared to the horizontally extending vessels of type A and type B.

Next, a third preferred embodiment of the present invention will be described with reference to FIGS. 11–14.

Figure 13:
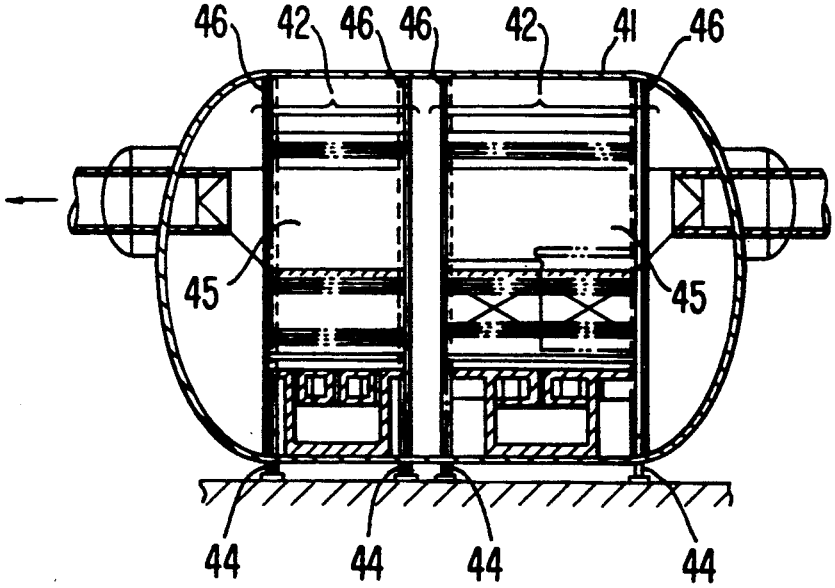
FIG. 13 is a longitudinal cross-sectional view of a pressure fluidized bed firing boiler of a horizontal type embodying the present invention.
Figure 14:
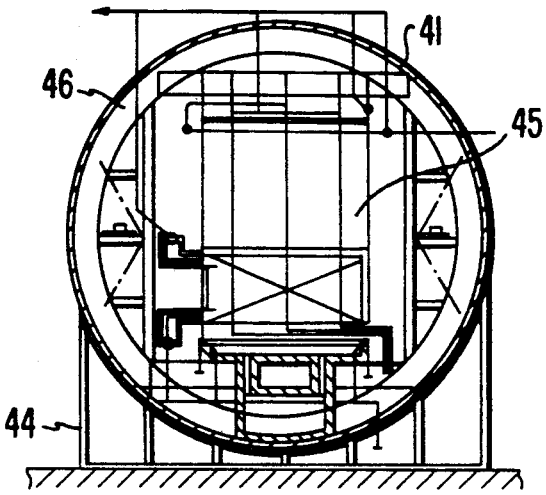
FIG. 14 is a cross-sectional view of the same.

At first, FIGS. 13 and 14 illustrate the entire horizontal pressure fluidized bed firing boiler embodying the present invention, in which a pressure fluidized bed firing boiler 42 is disposed within a cylindrical pressure vessel 41 of a horizontal type.

Figure 11:
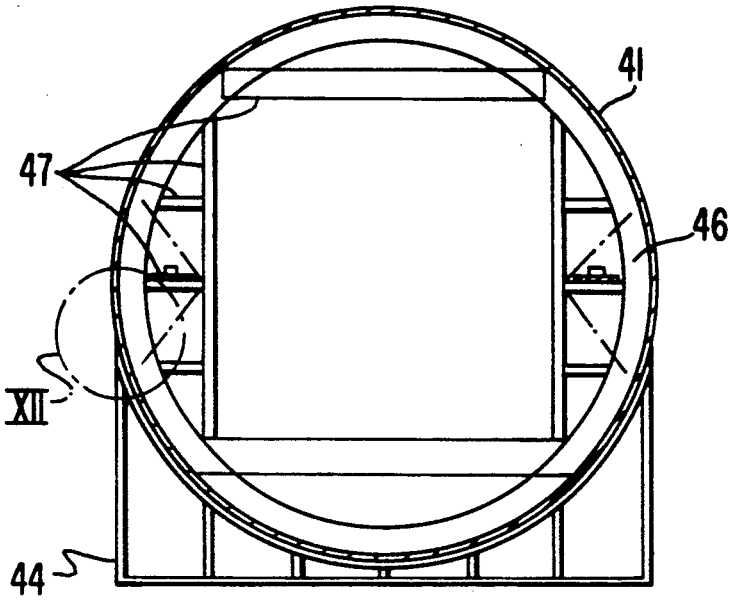
FIG. 11 is a schematic cross-sectional view of reinforcement structure of a pressure vessel for use in a pressure fluidized bed firing boiler of a horizontal type according to a third preferred embodiment of the present invention.
Figure 12:
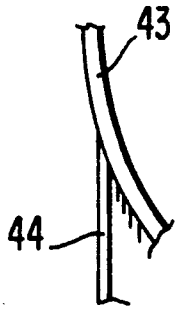
FIG. 12 is an enlarged view of the portion of the reinforcement structure encircled by line XII in FIG. 11.

Also, as best seen in FIGS. 11 and 12, a large number of support bases 44 are jointed to a shell 43 of the horizontal type pressure vessel 41 having a large diameter. Their positions correspond to support points for a fluidized bed main body 45 within the vessel.

According to the illustrated embodiment, to the inner circumference of the pressure vessel 41 are also mounted annular reinforcement beams 46 by welding. These annular reinforcement beams 46 and truss members 47 mounted to the side surfaces of the same annular reinforcement beams 46 are disposed at the same positions as the support bases 44 thereby forming a support section serving to support the fluidized bed main body 45. Among these truss members 47 are horizontal chord members which form maintenance passageways for accommodating appendant instruments of the fluidized bed main body 45.

Figure 15:
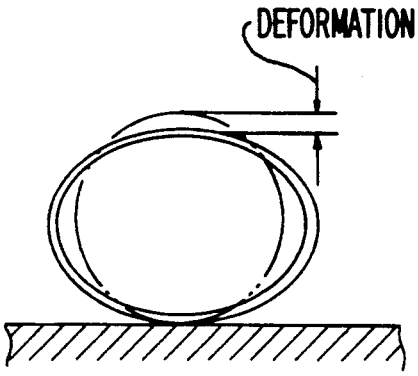
FIGS. 15, 16 and 17 are schematic views of a cylindrical vessel illustrating a flexed condition thereof and positions where generated stress is excessive, respectively.
Figure 16:
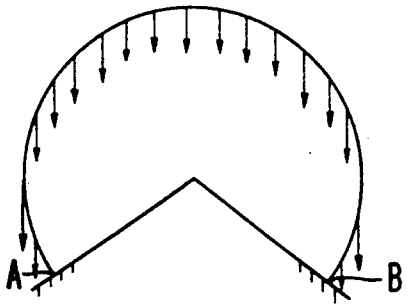
Figure 17:
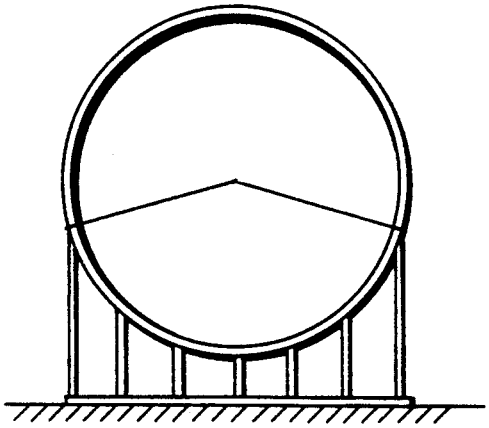

FIGS. 15 to 17 show a deformed condition and locations where excessive stresses are generated in a large-diameter cylindrical vessel in which the above-described annular reinforcement beams are not provided.

As shown in FIG. 15, the vessel would deform largely due to its own weight, and so it cannot maintain true roundness.

In addition, with reference to FIGS. 16 and 17, a localized load (maximum) due to the weight of the vessel itself acts upon jointed points A and B between a support saddle of the cylindrical vessel and the shell of the vessel, and with only the shell strength of the cylindrical vessel, it is impossible to suppress this localized load to less than an allowable stress.

The above-mentioned disadvantage can be obviated by providing reinforcements in the form of a truss structure including the annular reinforcement beams, because the annular reinforcement beams assuredly maintain the cylindrical cross section of the pressure vessel.

If the annular reinforcement beams were disposed outside of the vessel, then the vessel shell and the annular reinforcement beams would thermally expand under the temperature conditions at the inside and the outside of the vessel, and hence a difference in the amount of expansion would arise due to a difference in such temperatures at the inside and outside of the vessel. (Even if outside reinforcement beams were surrounded by heat insulating material, although the differences in the amounts of expansion could be mitigated during a steady operation, transient deviations in the rates of expansion would especially occur during starting or stopping and hence, differences in expansion would arise.) Due to the differences in the amounts of expansion, an excessive thermal stress would be generated at the jointed portion between the annular reinforcement beams and the vessel shell. In order to prevent this, according to this preferred embodiment, the annular reinforcement beams are disposed within the vessel. Consequently, a temperature difference between the vessel shell and the annular reinforcement beams will be small and thus, the generated thermal stress will be correspondingly small.

As described above, according to this preferred embodiment, owing to the fact that reinforcements formed of a truss structure and annular reinforcement beams are disposed on the inside of the vessel, both a large deformation of the vessel shell and a large stress generated at the jointed portion between the support saddle portion and the shell can be mitigated, whereby the cylindrical cross section is maintained to preserve the fluidized bed main body within the vessel.

In addition, because the reinforcement structure including the annular reinforcement beams also supports the fluidized bed main body and because chord members forming a truss jointed to the vessel shell are relatively small members, thermal stress at the jointed portion between the shell and the annular reinforcement beams can be inhibited.

Furthermore, since the horizontal members can be utilized to form maintenance passageways, there is also an advantage in that there is no need to provide separate members for forming such passageways.

While principles of the present invention have been described above in connection with preferred embodiments of the invention, it is a matter of course that many apparently widely different embodiments of the present invention can be made without departing from the spirit of the present invention.

We claim:

1. The combination of a cylindrical pressure vessel, a pressure fluidized bed firing boiler disposed within said pressure vessel, and support structure supporting said boiler in the pressure vessel, said boiler having a main body including a suspended section and a bottom-supported section, and said support structure including a support beam disposed at an upper interior portion of said pressure vessel and from which the suspended section of the main body of said boiler is suspended, a support beam disposed at a lower interior portion of said pressure vessel and supporting the bottom-supported section of the main body of said boiler at the bottom thereof, an expansion joint structurally interposed between said suspended section and the bottom-supported section of said pressure vessel so as to accommodate for differences in thermal expansion of said sections, the expansion joint comprising a metal plate having a plurality of undulations, and refractory heat-insulative material interposed between said metallic plate and the bottom-supported section of the main body of said boiler.

2. The combination as claimed in claim 1, wherein the suspended section of said boiler includes a fluidized bed peripheral wall and intralayer tubes, and the bottom-supported section of said boiler comprises fluidized material and a furnace bottom containing said material.

3. The combination as claimed in claim 2, wherein said refractory heat-insulative material is interposed between a side of said metallic plate and said fluidized material.

* * * * *